United States Patent [19]

Lanning

[11] Patent Number: 4,729,565

[45] Date of Patent: Mar. 8, 1988

[54] BOWLING AID

[76] Inventor: Michael E. Lanning, 15734 Hummel Rd., Brook Park, Ohio 44142

[21] Appl. No.: 896,636

[22] Filed: Aug. 15, 1986

[51] Int. Cl.[4] ..... A63B 71/02

[52] U.S. Cl. ..... 273/54 B

[58] Field of Search ..... 273/54 B, 189 A; 2/161 A; 128/87 R

[56] References Cited

U.S. PATENT DOCUMENTS

| | | | |
|---|---|---|---|
| 3,011,171 | 12/1961 | Pell | 273/54 B X |
| 3,606,342 | 9/1971 | Albertson | 273/54 B X |
| 4,407,499 | 10/1983 | Newton | 273/54 B |
| 4,608,720 | 9/1986 | Purin | 273/54 B X |

*Primary Examiner*—Anton O. Oechsle

*Attorney, Agent, or Firm*—Robert B. Henn

[57] ABSTRACT

An improved device to aid bowlers in delivery of a bowling ball under varying conditions with a substantially uniform mode of delivery comprises a main brace having a hand end and a forearm end, with a pad bearing upon the forearm and a pad bearing upon the hand or wrist of the bowler, and a strap for securing the brace to the arm of the bowler, the hand end of the brace having at least one receiving portion for an auxiliary support or brace. In a preferred embodiment, the brace has at least one auxiliary finger or hand support or brace removably affixed to the main brace. There is further provided a palm or hand strap, with an optional ball riser, insertable between the palm or hand strap and the user's hand.

8 Claims, 5 Drawing Figures

BOWLING AID

BACKGROUND OF THE INVENTION

1. Field of the Invention.

The present invention is in the field of aids for sporting endeavors; more particularly, this invention is in the field of devices to assist a bowler in holding a bowling ball for uniform delivery and maximum scores.

2. Description of the Prior Art.

Devices are known in various areas of individual sports to assist the sportsman in the particular field. Such devices include, e.g., sights for bows in archery, range finders in golf and specialized grips for target pistols.

In the field of bowling specifically, my U.S. Pat. No. 4,176,840, entitled Wrist Support, provides a means for additional bracing for a bowler in handling the ball, both to relieve muscle strain and to control the bowler's wrist movement during delivery, in an effort to produce a uniform, predictable delivery. Other devices with the same goal are known, including Cox, U.S. Pat. Nos. 3,423,095, and Albertson, 3,606,042.

There are also devices which support the hand, one or more fingers, or some combination. One device provides a support for the back of the bowler's hand and the index finger. The finger support comprises a metal stamping with a cushioned pad for the finger.

None of the devices cited, including my own, has fully met the need to provide a support which will provide the support needed. One specific problem which has not heretofore been solved to the general satisfaction of users of such devices is that of flexibility in the use of the device. In some cases, the bowler may want, e.g., a hand support only part of the time, or may want a support with a ball lift, or a finger support without untoward restriction on the movement of the finger.

SUMMARY OF THE INVENTION

The present invention is an aid for bowlers comprising a main brace having a hand end and a forearm end, with a pad for the forearm and a pad for the hand of the bowler, and a strap for securing the brace to the arm of the bowler, the hand end of the brace having at least one receiving portion for an auxiliary brace or support. In a preferred embodiment, the brace has at least one auxiliary brace or support removably affixed to the main brace. There is further provided a hand strap, with provision for insertion of an optional ball riser.

DESCRIPTION OF THE PREFERRED EMBODIMENTS

The most preferred embodiment of the present invention is an aid for bowlers comprising a main brace having a hand end and a forearm end, with a pad bearing upon the forearm and a pad bearing upon the hand or wrist of the bowler, and a strap for securing the brace to the arm of the bowler, the hand end of the brace having at least one receiving portion for an auxiliary support or brace. In a preferred embodiment, the brace has at least one auxiliary finger or hand support or brace removably affixed to the main brace. There is further provided a palm or hand strap, with an optional ball riser, insertable between the palm or hand strap and the user's hand. The present invention comprises, in various combinations, an improved device for supporting the wrist and hand of a bowler, with a main brace having a hand end and a forearm end, a forearm pad and hand pad, a strap for adjustably securing the brace to the arm of the bowler, the hand end of the brace having at least one receiving portion for at least one auxiliary support, ball-lift means cooperating with a palm strap, in a plurality of auxiliary support configurations.

Figure 1:
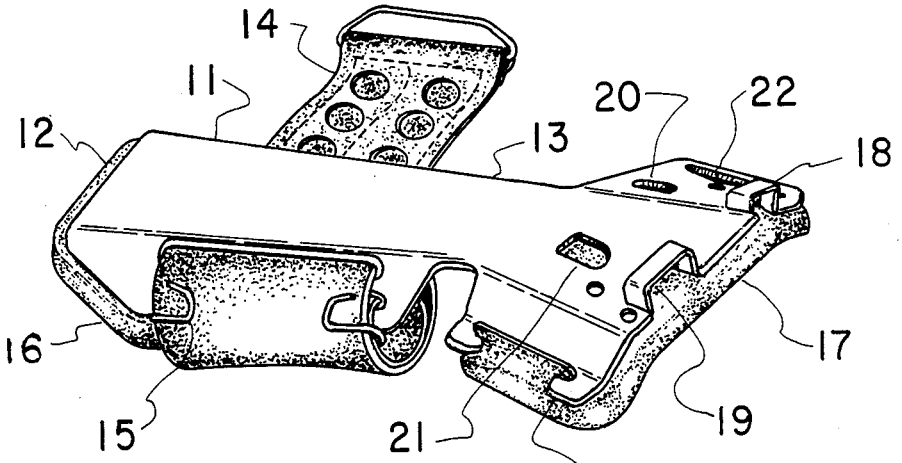
FIG. 1 is a view in perspective of the main brace of the present invention.

Turning now to FIG. 1, the main brace 11 of the invention terminates in a forearm end 12 and a hand end 13, and has a forearm strap 14 for securing the device to the forearm of the bowler. Main brace 11 has a forearm strap guide 15 to maintain forearm strap 14 in proper relationship to the main brace 11. Forearm strap 14 has adjustment means not shown, but well known to those skilled in the art, comprising, e.g., snaps, buttons, fabric with hook and loop-pile moieties, and the like. Forearm pad 16 and wrist or hand pad 17 provide resilient means to accommodate individual differences in bowlers' arm and hand conformation.

At hand end 13, finger-support attachment bracket 18 and hand-support attachment bracket 19, and finger-support attachment slot 20 and hand-support attachment slot 21, provide attachment means for auxiliary finger support 24 and auxiliary hand support 28 as discussed more fully hereinbelow. Also at wrist end 13, palm strap-slot 22 and palm-strap guide 23 provide attachment and alignment means for palm strap 32.

Figure 2:
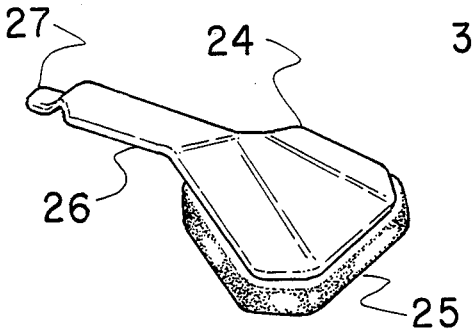
FIG. 2 shows a perspective view of the finger support.

In FIG. 2, finger support 24 is shown comprising finger-support pad 25, finger-support arm 26 and finger-support arm end 27.

Figure 3:
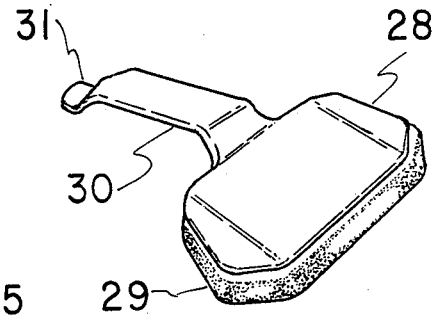
FIG. 3 is a perspective view of the hand support.

FIG. 3 shows hand support 28, having hand-support pad 29, hand-support arm 30 and hand-support arm end 31. Finger-support arm end 27 is installed by sliding finger-support arm end 27 and finger-support arm 26 through finger-support attachment bracket 18, and engaging finger-support arm end 27 in finger-support attachment slot 20. In a similar fashion, hand support 28 is emplaced by sliding hand-support arm end 31 and hand-support arm 30 through hand-support attachment bracket 19 and engaging hand-support arm end 31 in hand-support attachment slot 21. Both finger support 24 and hand support 28 are formed in such fashion that finger-support arm 26 and hand support arm 30 are urged against wrist pad 17 and hand-support attachment bracket 19, and into firm engagement in finger-support attachment slot 20 and hand-support attachment slot 21.

Finger support 24 and hand support 28 are auxiliary supports for one or a plurality of fingers of the bowler. These supports can be used singly or in combination, along with palm strap 32 and ball lift 35, depending on the circumstances and the bowler's wishes.

Figure 4:
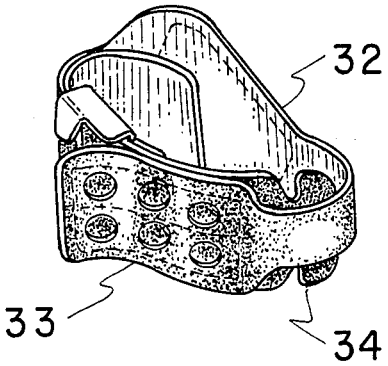
FIG. 4 depicts the palm strap of the invention.

The palm strap 32, in FIG. 4, provides additional support or rigidity in securing the user's arm to the device if desired. Palm-strap adjustment end 33 has adjustment means in a fashion similar to that provided for forearm strap 14, as described hereinabove; palm-strap slot end 34 is provided for insertion into palm-strap slot 22.

Figure 5:
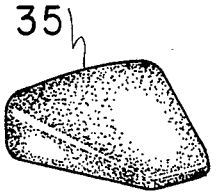
FIG. 5 shows the ball riser used with the palm strap.

FIG. 5 shows ball wedge 35; ball wedge 35 can be used to alter the position of the ball relative to the hand of the bowler.

In the utility of the present invention, the bowler simply affixes main brace 11 to the forearm with forearm strap 14, adjusting the device for optimum comfort in the positioning of forearm pad 16 and hand or wrist pad 17. The main brace 11 can be used without accessories, to provide additional strength and support for the bowler in handling the ball, either because the bowler may require such support to permit proper handling of the ball, or for the purpose of minimizing fatigue over a protracted time, such as might be encountered in a tournament.

Finger support 24 can be used to provide guidance and additional support generally for the index finger; the same is true for hand support 28. Those skilled in the art will realize that finger support 24 and hand support 28 can be used separately or together, depending upon the proclivities of the bowler.

Palm strap 32 can be used at the option of the individual, for guidance or support or both. Palm-strap slot end 34 is interfitted into palmstrap slot 22; palm-strap adjustment end 33 is then adjusted as appropriate. In connection with palm strap 32, ball wedge 35 can be placed between the palm of the bowler and palm strap 32, to affect the attitude of the ball with respect to the bowler's hand. By appropriate positioning and attitude of ball wedge 35, the bowler can cause the ball to rest relatively high or low on the hand, or close or somewhat distant. This relationship will affect the delivery of the ball and its subsequent approach to the pins, given a substantially uniform delivery.

Thus, by choice of the various attachments available with the present invention, and experimentation with their effect, the bowler can approach a maximum score. By way of illustration, the bowler may determine that under most game conditions, he requires only the main brace 11, but that in a very long series of games in a single span, palm strap 32 is necessary to maintain control due to fatigue. Further, given particular conditions of, e.g., temperature or humidity, the ball may not break in the same fashion to which he is accustomed, and he may determine that ball wedge 35 is necessary to produce the proper lift, spin or backup in order to achieve a maximum score.

The conformation of finger support 24 and hand support 28 permits the hand and fingers to move with substantial lateral freedom, but provides posterior support. This feature is a decided improvement over devices of the prior art, some of which restrict the movement of one or more fingers to the extent that smooth delivery of the ball can be seriously hampered for some bowlers whose hands may not fall within a particular range of size or shape. Additionally, the ability of the bowler to use several combinations of support features permits a choice of either one particular mode for customary use, or varying configurations depending on circumstances.

Those skilled in the art will understand that main brace 11, finger support 24 and hand support 28 can be made of any convenient material which will provide the physical strength necessary. Such materials include, e.g., metal such as steel of various grades, preferably stainless, and aluminum. Various polymeric materials can also be used, such as, e.g., polycarbonates, rigid vinyl, high-impact polystyrene, polyurethanes, polyamides and the like, both with and without reinforcement. Similarly, forearm pad 16, wrist pad 17, finger-support pad 25, hand-support pad 29 and ball wedge 35 can be chosed from any suitable resilient material such as, e.g., foamed plasticized polyvinyl chloride, polyurethanes, styrene-butadiene rubbers, and the like.

Modifications, changes and improvements to the preferred forms of the invention herein disclosed, described and illustrated may occur to those skilled in the art who come to understand the principles and precepts thereof. Accordingly, the scope of the patent to be issued herein should not be limited to the particular embodiments of the invention set forth herein, but rather should be limited only by the advance by which the invention has promoted the art.

What is claimed is:

1. An improved device for supporting the wrist and hand of a bowler, comprising a main brace having a hand end and a forearm end, a forearm pad and hand pad, and a strap for securing the brace to the arm of the bowler, the hand end of the brace having at least one attachment bracket and attachment slot for the attachment of at least one auxiliary support.

2. The device of claim 1 wherein at least a first auxiliary support having an arm and an end is removably affixed to the main brace by sliding the arm through the attachment bracket and engaging the arm end in the attachment slot.

3. The device of claim 2 having a first auxiliary support and a second auxiliary support removably affixed to the main brace.

4. The device of claim 2 wherein the auxiliary support provides support for at least one finger.

5. The device of claim 2 wherein the auxiliary support provides support for a plurality of fingers.

6. The device of claim 1 having further a palm strap affixed to the main brace.

7. The device of claim 6 having further ball-lift means cooperating with the palm strap.

8. The device of claim 1 having affixed thereto a plurality of auxiliary support means.

* * * * *